US005588955A

United States Patent [19]

Johnson, Jr. et al.

[11] Patent Number: 5,588,955

[45] Date of Patent: Dec. 31, 1996

[54] METHOD AND APPARATUS FOR PROVIDING THERAPEUTIC COMPRESSION FOR REDUCING RISK OF DVT

[75] Inventors: Glenn W. Johnson, Jr., Summit; Henry J. McVicker; David C. Hargrave, both of Chatham, all of N.J.

[73] Assignee: Aircast, Inc., Summit, N.J.

[21] Appl. No.: 421,040

[22] Filed: Apr. 12, 1995

Related U.S. Application Data

[63] Continuation of Ser. No. 88,895, Jul. 8, 1993, abandoned.

[51] Int. Cl.[6] ..... A61H 9/00

[52] U.S. Cl. ..... 601/152; 601/150; 128/DIG. 20; 602/13

[58] Field of Search ..... 601/1, 11, 148, 601/152; 602/13; 128/DIG. 20

[56] References Cited

U.S. PATENT DOCUMENTS

| | | | |
|---|---|---|---|
| 2,230,068 | 1/1941 | Roensch | 601/11 |
| 2,981,533 | 4/1961 | Wilson et al. . | |
| 3,391,692 | 7/1968 | Spielberg | 601/152 |
| 3,826,249 | 7/1974 | Lee et al. | 601/152 |
| 3,892,229 | 7/1975 | Taylor et al. | 601/152 |
| 3,896,794 | 7/1975 | McGarth | 601/152 |
| 3,901,221 | 8/1975 | Nicholson et al. | 601/152 |
| 3,942,518 | 3/1976 | Tenteris . | |
| 4,013,069 | 3/1977 | Hasty . | |
| 4,178,939 | 12/1979 | Stephens | 128/207.15 |
| 4,186,732 | 2/1980 | Christoffel | 601/152 |
| 4,370,985 | 2/1983 | Wright | 601/152 |
| 4,372,297 | 2/1983 | Perlin | 601/151 |
| 4,375,217 | 3/1983 | Arkans . | |
| 4,628,945 | 12/1986 | Johnson, Jr. . | |
| 4,877,378 | 10/1989 | Saggers . | |
| 5,109,832 | 5/1992 | Proctor . | |
| 5,125,400 | 6/1992 | Johnson, Jr. . | |
| 5,186,163 | 2/1993 | Dye . | |
| 5,218,954 | 6/1993 | Van Bemmelen | 601/151 |

OTHER PUBLICATIONS

Roberts, V. C., et al., "The Effect of Intermittently Applied External Pressure on the Haemodynamics of the Lower Limb in Man," *Brit. J. Surg.*, 59:3, 223–226, 1972.

Nicolaides, A. N., et al., "Intermittent Sequential Pneumatic Compression of the Legs in the Prevention of Venous Stasis and Postoperative Deep Vein Thrombosis," *Surgery*, 87:1, 69–76 1980.

Kamm, R. D., "Bioengineering Studies of Periodic External Compression as Prophylaxis Against Deep Vein Thrombosis—Part 1: Numerical Studies," *ASME J. Biomech. Engineering*, 104, 87–95, 1982.

Olson, D. A., et al., "Bioengineering Studies of Periodic External Compression as Prophylaxis Against Deep Vein Thrombosis—Part II: Experimental Studies on a Simulated Leg," *ASME J. Biomech. Eng.*, 104, 96–104, 1982.

Kamm, R., et al., "Optimisation of Indices of External Pneumatic Compression for Prophylaxis Against Deep Vein Thrombosis: Radionuclide Gated Imaging Studies," *Cardiovascular Research*, XX:8, 588–596, 1986.

Salvian, A. J., et al., "Effects of Intermittent Pneumatic Calf Compression in Normal and Postphlebitic Legs," *J. Cardiovasc. Surg.*, 29, 37–41, 1988.

(List continued on next page.)

*Primary Examiner*—Richard J. Apley
*Assistant Examiner*—Jeanne M. Clark
*Attorney, Agent, or Firm*—Jones, Day, Reavis & Pogue

[57] ABSTRACT

A method and apparatus are disclosed for providing therapeutic intermittent pneumatic pressure to a body portion. An air reservoir receives a substantially steady flow of pressurized air from a pump. Pressure is applied as a rapid pulse from the reservoir to a cuff means in contact with the body portion so as to promote acceleration of venous blood flow in the body portion. In a preferred embodiment, the pneumatic pressure is applied in a graduated manner and/or sequentially distally to proximally along the body portion. A simplified carrying arrangement is provided for the system.

15 Claims, 5 Drawing Sheets

OTHER PUBLICATIONS

Salzman, E. W., et al., "Effect of Optimization of Hemodynamics on Fibrinolytic Activity and Antithrombotic Efficacy of External Pneumatic Calf Compression," *Ann. Surgery,* 636–647, 1987.

Airaksinen, O., et al., "Elastic Bandages and Intermittent Pneumatic Compression for Treatment of Acute Ankle Sprains," *Arch. Phys. Med. Rehabil.,* 71, 380–383, May, 1990.

Gardner, A. M. N., et al., "Reduction of Post–Traumatic Swelling and Compartment Pressure by Impluse Compression fo the Foot," *J. Bone and Joint Surgery,* 72–B:5, 810–815, Sep. 1990.

Wilkerson, G., "Treatment of the Inversion Ankle Sprain Through Synchronous Application of Focal Compression and Cold," *Athletic Training,* JNATA 26, 220–237, 1991.

Flam, E. (NTL Associates, Inc.), "Femoral Vein Blood Velocities With Intermittent Compression Systems: Implications for DVT Management." Poster Exhibit, AAOS, 1992 (29 Ainsworth Ave., E. Brunswick, N.J. 08016).

Product Brochure on Flowtron®DVT, Huntleigh Healtcare, Manalapan, N.J., 1992.

Informational sheet and letter on Deep Venous Thrombosis and Pulmonary Embolism, Advanced Instruments Inc., Norwood, Massachusetts, May 7, 1993.

Product Brochure on Jobst Arthrombic Pump®System 2000, Jobst, Toledo, Ohio, (undated).

Product Brochure on SCD Compression System, Kendall Healtcare Products Company, Mansfield, MA, 1991.

Product Brochure on Plexipulse, NuTech, San Antonio, Texas, 1993.

Product Brochure on P.A.S. (Pulsatile Anti–Embolism System), Baxter Healthcare Corp., Valencia, CA (undated).

Product Brochure on Hemaflo 2® Intermittent Compression system, Camp International, Inc., Jackson, Michigan (undated).

Fig. 5
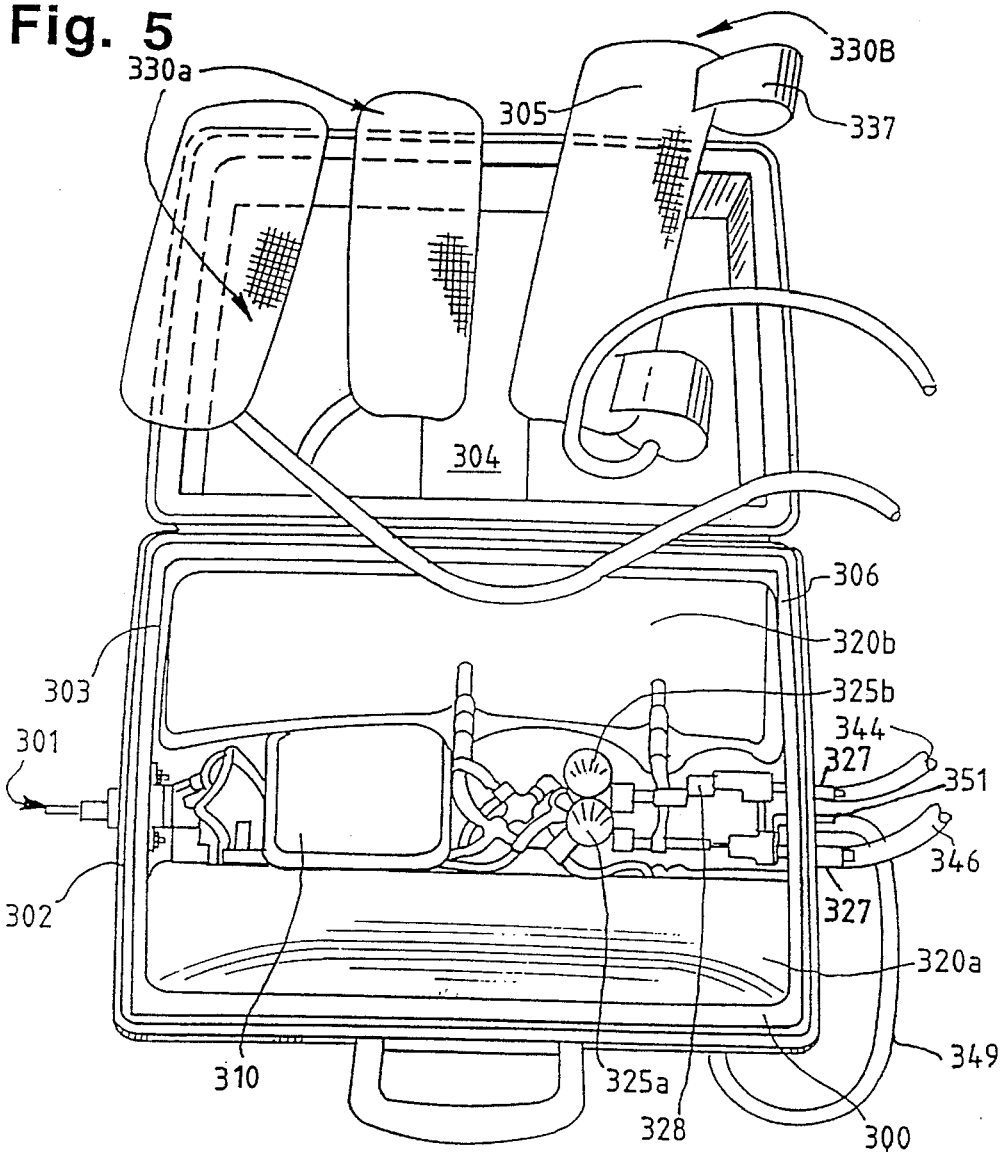
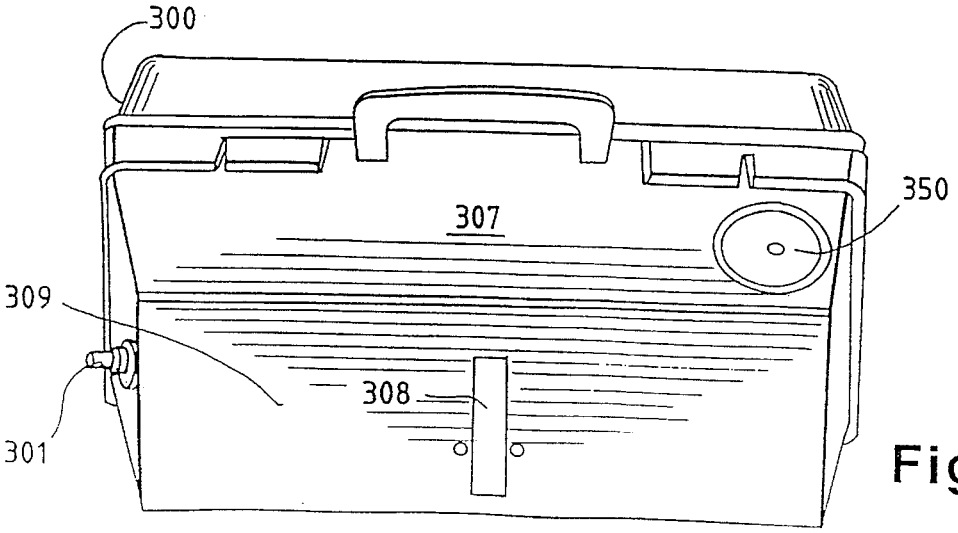
Fig. 6

METHOD AND APPARATUS FOR PROVIDING THERAPEUTIC COMPRESSION FOR REDUCING RISK OF DVT

This is a continuation of application Ser. No. 08/088,895 filed on Jul. 8, 1993 now abandoned.

BACKGROUND OF THE INVENTION (1) Field of the Invention

The present invention relates in general to improvements in a therapeutic system for producing automatic intermittent compression to minimize or prevent deep vein thrombosis (DVT). More specifically, it relates to a system including a source of intermittent pressure and one or more pressurizable chambers attached to a human leg for providing treatment by applying intermittent compression to the leg by means of the chambers to accelerate the flow of venous blood and thereby minimize the risk of or prevent DVT. In a preferred embodiment, two or more chambers are used and the intermittent compression may be graduated along the body portion to which it is applied, and may also be applied sequentially to the two or more chambers.

(2) Background of the Invention

Therapeutic intermittent pneumatic compression of the leg for the prevention of DVT after surgery has been used for more than twenty years, and a variety of devices, many patented, have been developed for its application. Even with these devices, the incidence of DVT remains relatively high and the use of existing equipment is somewhat limited because of its high cost and patient discomfort. A clear and well recognized need exists for a system that is more effective, less costly, and more comfortable for the patient.

Intermittent pneumatic compression is the technique of cyclically compressing the limb with air pressure so as to enhance circulation of blood. It has been shown effective in reducing the risk of thrombosis after surgery and for treatment of vascular deficiencies. The pressure is applied from a source of compressed air by a control mechanism that intermittently inflates a cuff enveloping the arm or leg. The period of compression is typically short, ten seconds or so, and the interval between pulses about a minutes, studies having shown this to be the time required for the veins to refill after being emptied by the short pulse of compression.

Studies have also shown that the optimal amount of compression is in the range of 35 to 45 mm hg, and that the velocity of the venous flow during the period of compression is proportional to the rate at which the pressure rises. For example, a pulse that rises to 35 mm hg in six seconds accelerates venous velocity by several times that of a pulse that requires 30 seconds. Because it is this acceleration of venous flow that is believed to reduce the risk of pooling and clotting of blood in the deep veins, the rate of pressure rise is a critical variable of effectiveness in reducing the risk of or preventing DVT. Cost and comfort are also variables, because the more expensive and less comfortable devices are less likely to be used.

It has been shown that intermittent pneumatic compression (IPC) is more effective in preventing DVT when there is a higher velocity of venous flow during the period of compression. Graduated intermittent pneumatic compression of fluid chambers applied to an injured body portion is well known and its efficacy is broadly accepted by the medical profession. With graduated IPC, pressures of different magnitude are applied to different regions of the body portion being treated. Most typically higher pressure are applied to the distal regions and lower pressures are applied to the proximal regions. IPC may also be applied sequentially, with the distal region of the treated limb being pressurized slightly before the proximal region. It also has been reported that a combination of sequential and graduated compression may be the most effective in providing accelerated venous flow.

Roberts, et al., "Hemodynamics of the Lower Limb in Man," *Brit. J. Surg.*, Vol. 59, No. 3, pp. 223–226, March 1972, reports that intermittent pressure applied with an inflatable plastic splint causes an increase in venous peak flow directly proportional to the rate of pressure application, being maximal at about 10 mmHg per second, with the maximum being reached when the pressure is applied at 1 minute intervals.

Nicolaides, et al., "Intermittent sequential pneumatic compression of the legs in the prevention of venous stasis and postoperative deep venous thrombosis," *Surgery*, Vol. 87, No. 1, pp. 69–76, January, 1980, discloses tests with a multi-chamber sequential pressure device. Optimal pressures were found to be 35 mmHg for the ankle, 30 mmHg for the calf, and 20 mmHg for the thigh, which produced a 140% increase in blood velocity, higher pressures did not cause any increase in blood velocity.

Salvian, et al., "Effects of intermittent pneumatic calf compression in normal and postphlebitic legs," *J. Cardiovasc. Surgery*, 29, 1988, pp. 37–41, evaluated two sequential compression devices and one single chamber device. Correct calf application was found to be critical in achieving an increase in blood velocity.

Most of the systems known for producing IPC are large, expensive, complex and uncomfortable for the patient. For example, in U.S. Pat. No. 4,013,069, a system is disclosed that treats deep vein thrombosis in the thigh, the calf, and the ankle. This prior art system is accomplished with an elaborate system of multiple lines and mechanical valves and a multiplicity of tubes leading from a complex control system to the air cells about the leg. The system also is complicated and apparently requires four timers, three pneumatic shift valves, and a separate tube from the controllers to each of the six pressure zones. It also requires means for intermittently initiating periodic deflation cycles at the end of inflation cycles. As will be seen, this is opposite to the system of the present invention, in which the pump operates continuously and the air cells exhaust automatically, at a rate great enough to permit rapid pressure drop.

There is a need for a device that provides graduated IPC and that is small, lightweight, economical to construct and operate, comfortable for the patient and efficient to use.

(3) Objects of the Invention

The principal objective of the present invention is to provide a system for intermittent pneumatic compression that provides faster inflation, less complexity, lower cost, and greater patient comfort. These seemingly contradictory goals are achieved by employing unique strategies for the way in which the compressed air is accumulated and released to inflate the cuff; for the way compression is applied to the leg, and for the design of the cuff to facilitate inflation.

It is an object of the invention to provide a system for applying therapeutic intermittent pneumatic pressure to a limb, wherein said pressure is applied with rapid acceleration to effect therapeutic venous flow acceleration.

It is yet another object of the invention to provide a system for applying therapeutic intermittent pneumatic pressure to a limb, wherein said pressure is applied with more rapid acceleration than in prior art designs, to thereby effect therapeutic venous flow acceleration, and wherein said system is of relatively simple construction and relatively low cost.

It is yet another object of the invention to provide such a system for applying therapeutic intermittent pneumatic pressure to a limb, wherein said system affords greater patient comfort than prior art systems.

It is still another object of the invention to provide a system which provides graduated, sequential therapeutic intermittent pneumatic pressure to a limb.

Yet another object of the invention is to provide the entire system in a conveniently arranged carrying device which accommodates easy mobility and set up of the system.

Other objects, advantages, and novel features of the instant invention will be readily apparent to those skilled in the art from the following description and drawings.

SUMMARY OF THE INVENTION

In accordance with the simplest version of the invention, a system for applying therapeutic intermittent pressure to a limb is provided comprising a pump, a reservoir which receives pressurized air from the pump, an inflatable cuff for sequentially applying pressure to the limb, means for intermittently and quickly transmitting pressurized air from the reservoir to the inflatable cuff, and pressure relief means operatively coupled to the inflatable cuff for limiting the pressure therein. In operation, the pump operates substantially continuously to supply a steady flow of pressurized air to the reservoir. The means for intermittently transmitting pressurized air from the reservoir to the inflatable cuff comprises a valve operatively disposed between the reservoir and the cuff and a timer operatively coupled to the valve. The valve is normally in a closed position, so that pressurized air is allowed to build up in the reservoir to a level several times above that normally desired for therapeutic compression. The timer is set to open the valve to release pressurized air from the reservoir to the inflatable cuff at predetermined intervals and for a predetermined duration. This results in a very rapid pressurization of the inflatable cuff which in turn leads to greater acceleration of venous flow, and thus more effective therapy to the affected limb. The valve preferably is a two way valve so that when closed to the reservoir it is open to atmosphere, allowing depressurization of the cuff.

In a preferred embodiment of the invention, the inflatable cuff is configured so as to apply pressure to the affected limb as efficiently as possible. Specifically, the cuff is configured to apply pressure to only the medial and lateral aspects of the limb, leaving open the anterior and posterior aspects, such that collateral (rather than circumferential) compression is achieved. In this preferred embodiment, the cuff comprises a pair of semirigid shells intended to be disposed along the medial and lateral aspects of the limb, with one or both of said shells being provided with one or more inflatable bladders along the inner surfaces thereof. The shells are secured around the injured limb such that when the valve is opened the bladders are pressurized and the semirigid shells resist such pressure, so that all the pressure is directed to the interior of the limb along the medial and lateral aspects thereof. One or more of the inflatable bladders is provided with an interior foam liner which partly fills the internal volume of the bladder(s) to promote rapid pressurization. The cuff of this preferred embodiment is also more comfortable for the patient than prior art cuff devices which encompass the entire circumference of the affected limb.

In the preferred embodiment of the invention, the system may be made convenient and easy to use for the patient by mounting the pump, timer, valves and reservoirs within a convenient relatively rigid carrying case. This arrangement makes it simple for the system, including the inflatable cuff, to be transported and set up at the patient's comfort and convenience. In another version, a toroidal shaped reservoir has been found suitable for this purpose, although other shapes such as hollow boxes or cubes also may be used.

In the preferred embodiment of the invention, the system is configured to provide therapeutic intermittent pneumatic pressure to an affected limb, which pressure is applied in a graduated manner and/or sequentially along the limb, preferably from the distal end to the proximal end thereof. In this configuration, the system further comprises a second reservoir, and the cuff means is divided into first and second bladders, such that each of the first and second bladders is in fluid communication with the first and second reservoirs respectively, with the first bladder disposed along the distal region of the limb and said second bladder disposed along the proximal region thereof. In operation, the timer is set to open the first valve to transmit a pulse of pressurized air from the first reservoir to the first bladder, and shortly thereafter the timer opens the second valve to transmit a pulse of pressurized air from the second reservoir to the second bladder, such that pressure is applied sequentially distally to proximally along the affected limb. The pressure achieved in the two bladders need not be equal. Typically, the pressure in the first (distal) bladder will be greater than the pressure in the second (proximal) bladder, such that graduated therapeutic IPC is achieved. By means of the system of the instant invention, the pressure rise in the first and second bladders is relatively rapid, such that the acceleration of venous flow is greater than in prior art devices and the therapeutic effect is thereby enhanced.

DESCRIPTION OF THE FIGURES

Understanding of the detailed description of the invention will be enhanced by the accompanying figures, wherein like reference numerals indicate like parts, and wherein

FIG. 5 illustrates a preferred arrangement for providing the system of FIG. 4 in a convenient case for transport and set up;

FIG. 6 is a perspective view of the carrying case of FIG. 5, in closed condition, showing other aspects of the invention.

DETAILED DESCRIPTION OF THE INVENTION

In the following description of the preferred embodiment of the instant invention, the system will be described in the configuration wherein therapeutic compression is provided to an affected limb for the minimization of risk of or prevention of DVT. It will be understood that the system is not necessarily so limited, and that it may be possible to adapt the system of the instant invention to other affected body portions, and other than limbs and still remain within the scope and spirit of the invention.

Figure 1:
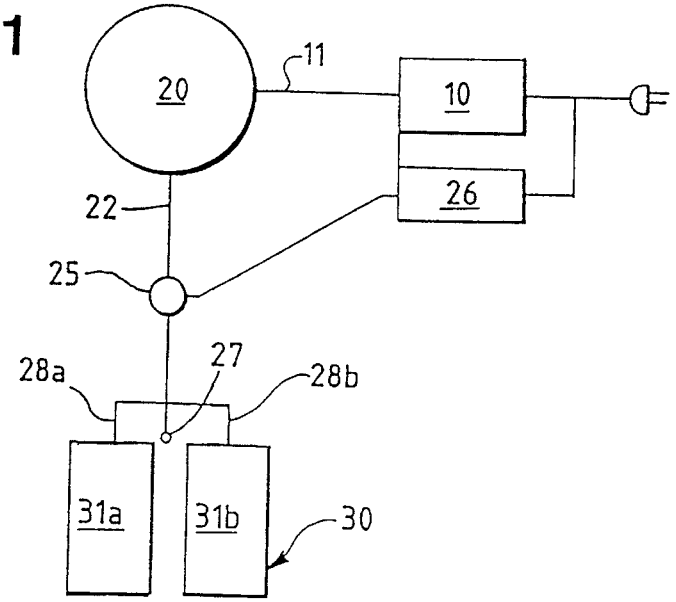
FIG. 1 is a schematic representation of a simplified version of the system of the instant invention.

As shown in FIG. 1, the simplified system of the prevent invention comprises a pump means 10 which is in fluid communication via tube 11 with a reservoir 20. The pump 10 is capable of operating on a substantially continuous basis to supply a steady flow of pressurized air to the reservoir 20. For economy and simplicity, the pump 10 is preferably small, inexpensive, and lightweight; a suitable type of pump is that which is commonly used to aerate a small aquarium, having a flow rate of about 1000–1500 cc/min and an output air pressure of about 200 mm/Hg, such as those manufactured by EIKO ELECTRIC of Taiwan.

The reservoir 20 may be made of any strong, inelastic air-impervious material; urethane film reinforced with nylon cloth is suitable. The reservoir 20 is in fluid communication via tube 22 and two-way valve 25 and tubes 28*a* and 28*b* with inflatable cuff means designated generally as 30, which means provides pressure directed to the interior of the limb.

The capacity of such pumps is of course far too small to inflate conventional cuffs in the few seconds necessary for effective performance. It is possible to overcome this limitation, and indeed provide faster inflation, by having pump 10 run continuously, not only during the brief period of inflation, as in conventional systems, but also during the interval of a minute or so between pulses. During this interval, compressed air accumulates in reservoir 20, and rises to a pressure four or five times that appropriate for compression of the limb. When a timer 26 calls for inflation of cuff means 30, the two-way solenoid valve 25 is energized and compressed air flows quickly from reservoir 20 to cuff means 30. This relatively large volume of air at high pressure fills cuff 30 in less than about one second, but a fraction of the time required by conventional systems, even though pump 10 is small and inexpensive. While the air from reservoir 20 flows to cuff 30 at high pressure, the pressure in cuff 30 is limited to the desired level of 35 to 45 mm hg by a pressure relief valve 27.

The cuff means 30 may be in the form of a wrap-around cuff that compresses the limb circumferentially, as is known in the prior art, or, as part of the present invention, in the preferred embodiment, the cuff means 30 may be configured as two opposing cuff members schematically 31*a* and 31*b*, to apply pressure to only the medial and lateral aspects of the limb, leaving open the anterior and posterior aspects, and resulting in collateral compression.

While it is believed that collateral compression may be more effective in treating edema than circumferential pressure, applicants herein have found that, surprisingly, collateral compression is more effective than circumferential compression for providing therapeutic compression to the deep veins of a limb in preventing DVT. In addition, the collateral compression cuff means is more comfortable to the user and more easily applied, so it is more likely to be used, and used correctly.

It has also been learned that where compression of the deep veins of the leg is required, efficient compression can be achieved where the cuff means 30 is configured to contact only the area of the calf, rather than the full length of the leg. This further reduces the volume of the cuff means 30 to be pressurized, and thus facilitates rapid pressurization, and also enhances patient comfort by reducing the area of skin covered by the cuff. In this preferred embodiment, the efficiency of the pressurization of the cuff means 30 is enhanced by reducing pre-inflation voids in the cuff means and by directing the pressurization inwardly toward the limb, while restricting outward expansion.

Figure 2:
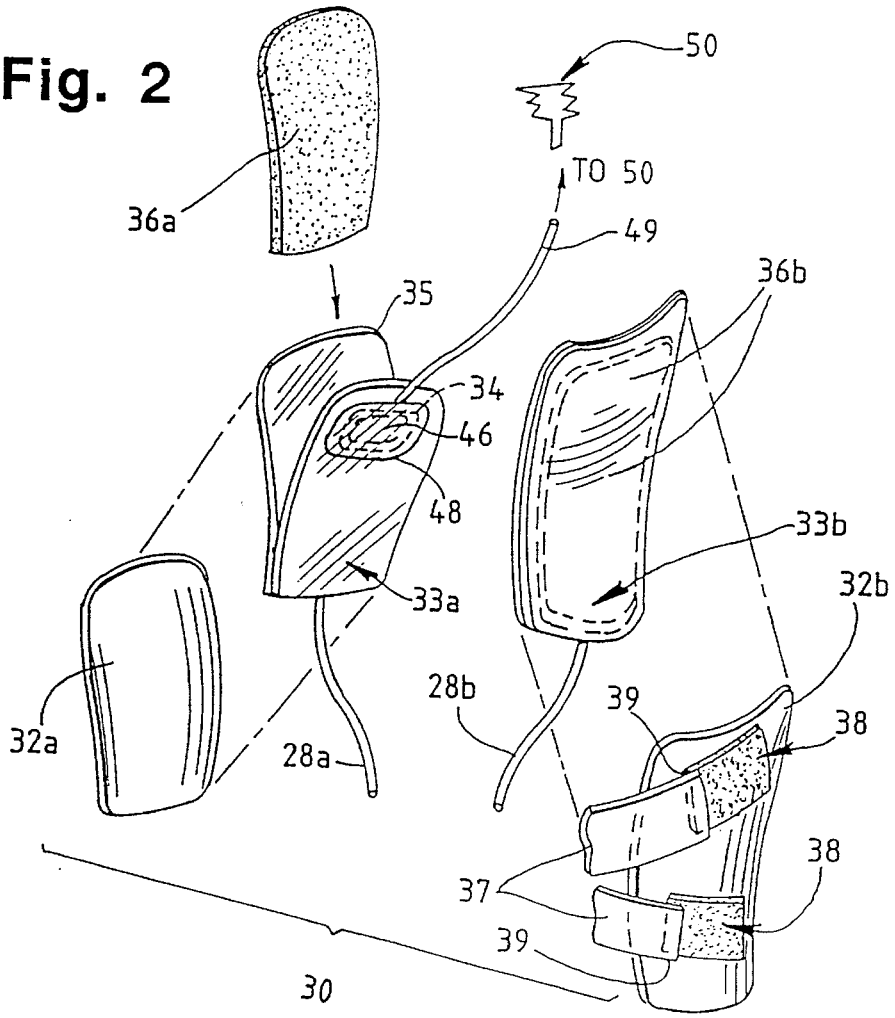
FIG. 2 illustrates a preferred embodiment of the cuff means of the instant invention.

As shown in FIG. 2, the cuff means 30 preferably comprises a pair of cuff members 31*a*, 31*b*, each formed of semirigid shells 32*a* and 32*b* which may be molded of a durable thermoplastic material such as polypropylene, and are in the general shape of the medial and lateral aspects of the limb to which they are to be applied. In the case where the therapeutic pneumatic pressure is to be applied to the medial and lateral aspects of the calf, then the shells 32*a* and 32*b* can be about 11 inches long, about 4 inches wide, and about 0.1 inches thick, and may taper toward the distal end for patient comfort.

As shown in FIG. 2, each semirigid shell 32*a* and 32*b* is provided on its interior surface with an inflatable bladder 33*a* and 33*b*, constructed in accordance with the disclosure of commonly assigned U.S. Pat. No. 4,628,945, incorporated herein by reference. As shown in FIG. 2, each inflatable bladder may comprise two layers 34 and 35 of strong, fluid impervious plastic film. An appropriate material is 12 mil polyvinylchloride (pvc). Layers 34 and 35 are sealed to one another about their perimeter to form an inflatable bladder. Each bladder 33*a* and 33*b* is fitted with an inlet tube 28*a* and 28*b* respectively. In the preferred embodiment each bladder is provided with a thin layer of open cell foam material 36*a* and 36*b*. Foam layers 36*a* and 36*b* may be made, for example, of foamed polyurethane and may have a thickness of about 0.250–0.300 inches. Foam layers 36*a* and 36*b* facilitate the rapid pressurization of bladders 33*a* and 33*b*, as will be explained in more detail hereinafter.

The exterior of shells 32*a* and 32*b* are provided with a pair of straps 37, to secure the pair of cuff members 31*a*, 31*b* to the affected limb. The straps may be provided with mating hook and loop type fastening means 38, 39, or other fastening means, preferably adjustable, as is known in the art.

In preferred embodiment, the straps 37 may be attached to a disposable sleeve of cloth-covered, air-impervious material (See FIG. 5) that slips over each shell structure. This permits the cuff means 30 to be reused, while providing a fresh, sterile, and economical cover thereof for each patient. This is a significant advantage over prior art systems which require that the entire cuff means be replaced for each patient.

When the cuff means 30 is properly secured by straps 37 to the affected limb, then the semirigid shells 32*a* and 32*b* resist outward expansion of the inflatable bladders 33*a*, 33*b* so that compression is efficiently directed inwardly toward the limb.

Referring again to FIG. 1, the simplest version of the system of the instant invention further comprises the two-way valve means 25 operatively disposed between the reservoir 20 and cuff means 30, the timer 26 operatively coupled to the valve means 25, and the pressure relief valve 27 operatively coupled to the cuff means 30. The valve means 25 may be a two-way solenoid valve as is known in the art. The timer 26 may be set to operate the valve means 25 at predetermined intervals and for predetermined periods of time, as hereinafter noted. When the valve normally is "closed" it prevents communication between the reservoir 20 and cuff means 30, while simultaneously permitting air in the bladders 33*a*, 33*b* and in tubes 28*a*, 28*b*, to exhaust to atmosphere. When the valve 25 opens to the reservoir 20, it also closes communication of the bladders 33*a* and 33*b* to atmosphere.

In operation, the system of the instant invention provides pulsed, or intermittent, therapeutic pneumatic compression to an affected limb. The pump means 10 provides a steady flow of compressed air to the reservoir 20 which is of substantially greater volume than the bladders in cuff means 30. The pressure within the reservoir 20 is intended to reach a level of about four to five times that normally used for therapeutic compression. At predetermined intervals, the timer 26 energizes valve means 25, causing it to open for a predetermined duration, such that a pulse or sudden rush of pressurized air fills the bladders 33*a* and 33*b* of cuff means 30. The pressure relief valve 27 is of such size and capacity to prevent bladders 33*a* and 33*b* from becoming overpressurized. When the pulse is over, the valve means 25 is de-energized and returns to its closed condition, allowing the pressurized air in bladders 33*a* and 33*b* to bleed out through the two-way valve 25 at a desired rate such that bladders 33*a* and 33*b* return to ambient pressure.

The rapid rate of pressurization of the bladders has been shown to accelerate venous flow in the treated area. Rapid acceleration of venous flow has been shown to be therapeutic, particularly in the minimization or prevention of pooling or clotting of the blood in the deep veins. The greatly accelerated pressurization provided by the instant invention is highly advantageous over prior art pressurization systems which directly couple the pump means to the cuff means. In such prior art systems, the rate of pressurization is limited by the capacity of the pump and necessarily occurs relatively slowly, so that the rapid acceleration of venous flow as achieved by the present invention and the therapeutic advantages associated therewith, are not attained.

In accordance with the instant invention, the timer 26 may be set such that the valve means 25 is open for about three to ten seconds, and preferably for about three to five seconds, and at intervals of about sixty seconds. Studies have shown that this interval is required for the veins to refill with blood after being emptied by the short pulse of compression. The reservoir 20 should be sized relative to the cuff means 30 such that when the valve means 25 is opened, the cuff means 30 reaches the desired pressure level in about one second or less, preferably in about 0.5 seconds. The desired pressure level for the cuff means 30 will generally be about 35–55 mmHg above ambient. The pressure in the reservoir 20 just prior to the opening of the valve means 25 may be about 180 mmHg or higher.

One of the bladders, 33*a*, may be provided at its proximal end with a sealed aircell 48 which is in fluid communication by means of tube 49 to a pressure level indicator provided by bellows 50.

The aircell 48 may be preinflated with a foam liner 46. If the cuff means 30 is properly applied to the affected limb, then the aircell 48 will be compressed slightly to cause a slight visible expansion of the bellows 50. This gives a visible indication that the cuff means 30 is on correctly but not too tight. Then, when the system is operating, each pressurization pulse causes full expansion of the bellows 50. The bellows 50 thus provides a visual indication that the system is applied and is functioning correctly to deliver therapeutic IPC to the affected limb. It will be seen that if the cuff means 30 is not properly applied to the affected limb, then the aircell 48 will not be compressed during a pressurization pulse, and the bellows 50 will not respond. This is a distinct advantage over prior art "indicators" which respond to internal system pressure, regardless of whether the cuff means is properly secured to the limb.

It will be appreciated that rapid pressurization of the bladders 33*a* and 33*b* is important to the effectiveness of the therapeutic pressure provided by the instant invention. Such rapid pressurization is facilitated by reducing the amount of air required to inflate the cuff means 30. The foam layers 36*a* and 36*b* disposed within the bladders 33*a* and 33*b* have been found to reduce the pre-inflation voids within the bladders 33*a* and 33*b* and thus reduce the amount of air required to inflate them to the desired pressure, while still allowing the application of therapeutic pressure. In addition, if desired one of the bladders 33*a* or 33*b* may be preinflated to a desired pressure and permanently sealed. Then when the cuff means 30 is applied and used correctly, only the non-sealed bladder need be inflated to provide the desired intermittent application of pressure. Typically, the bladder for the lateral aspect of the limb will be pre-inflated and permanently sealed, and the bladder for the medial aspect will be cyclically inflated and deflated.

In an alternative preferred embodiment of the invention, the system may be designed to provide intermittent therapeutic pneumatic pressure to an affected limb in which pressure is graduated, or sequential, or both. It is known in the prior art to provide a sequential pressure system, wherein pressure is not applied to the entire affected area simultaneously. Rather, the pressure is applied in a sequential manner over the surface of the affected area of the body, preferably beginning at the distal region and then progressing toward the proximal region. It is also known to apply graduated pressure to an affected area. In this mode of operation, unequal pressures are applied to the distal and proximal regions of the affected limb. Typically, greater pressure is applied to the distal region and less pressure is applied to the proximal region, to promote the flow of blood toward the heart.

The benefits of graduated and sequential intermittent pressure application are well-known in the art of therapeutic pressure devices for presenting DVT. In the past, however, devices capable of provided graduated and/or sequential intermittent therapeutic pneumatic pressure to a limb were large, cumbersome, uncomfortable, complex, and slow to inflate and therefore much less effective in accelerating blood flow.

Another embodiment of the system of the instant invention provides the rapid venous acceleration which gives improved therapy as described above, and also allows for such rapid acceleration to be applied in a graduated manner, or sequentially, or both. This embodiment is illustrated schematically in FIG. 3. As may be seen, the reservoir 120 may be divided by seals 121 into two compartments 120*a* and 120*b*. As shown, the pump means 110 has two outlets which are connected via tubes 111*a* and 111*b* to be in fluid communication with the compartments 120*a* and 120*b*, respectively.

Each compartment 120*a* and 120*b* is provided with an outlet tube 122*a* and 122*b*, and a valve means 125*a* and 125*b*, respectively. The valves are connected by tubes 141*a* and 141*b* to a common manifold 140, which is provided with pressure relief valves 143*a* and 143*b* to prevent overpressurization thereof.

The bladders 133*a* and 133*b* of the cuff means 130 are each divided into distal portions 145*a* and 145*b* and proximal portions 147*a* and 147*b*. The tubes 144*a* and 144*b* lead from the manifold 140 to the distal portions 145*a, b*, and the tubes 142*a, b* lead from the manifold 140 to the proximal portions 147*a* and 147*b*. At least one of the proximal portions 147*a* may have mounted thereon a sealed aircell 148. A tube 149 leads from the sealed aircell 148 to a bellows 150.

In operation, the pump means 110 is run continuously to provide a steady flow of air to the compartments 120*a* and 120*b* of the reservoir 120. The compartments preferably reach a pressure in the range of about 160–200 mmHg. After about sixty seconds, a timer (not shown) opens the valve means 125*a*, discharging pressurized are from reservoir 120*a* and rapidly inflating the distal portions 145*a* and 145*b* of the bladders 133*a* and 133*b*. Generally about one second later or less, the timer opens the valve means 125*b*, discharging chamber 120*b* and rapidly inflating the proximal portions 147*a* and 147*b* of the bladders 133*a* and 133*b*. This delay in inflation of the proximal portions relative to the inflation of the distal portions produces the desired sequential IPC. The pressure relief valves 143*b* and 143*a* prevent over inflation of the distal portions 145*a, b* and proximal portions 147*a, b* respectively. The pressure relief valves 143*a* and 143*b* may also be set so that the pressure in the distal and proximal portions is not equal. Generally, the pressure in the distal portions will be greater than that in the proximal portions. The unequal pressures in the distal and proximal portions produce the desired graduated IPC. In particular, pressures of about 50 mmHg for the distal portion and about 40 mmHg for the proximal portion are preferred.

The sealed aircell 148 and the bellows 150 function together to indicate whether the cuff means 130 of the instant invention is being used and applied properly, as described above in connection with the aircell 48 and the bellows 50 of the embodiment of FIGS. 1 and 2.

From the discussion above, it will be appreciated that this alternative embodiment of the invention may be even further simplified in its construction by preinflating and permanently sealing one of the bladders 133*a* or 133*b*. In such a construction, it would be necessary to have only a single tube leading from the manifold 140 to the distal portion 145, and only a single tube leading from the manifold 140 to the proximal portion 147.

Figure 3:
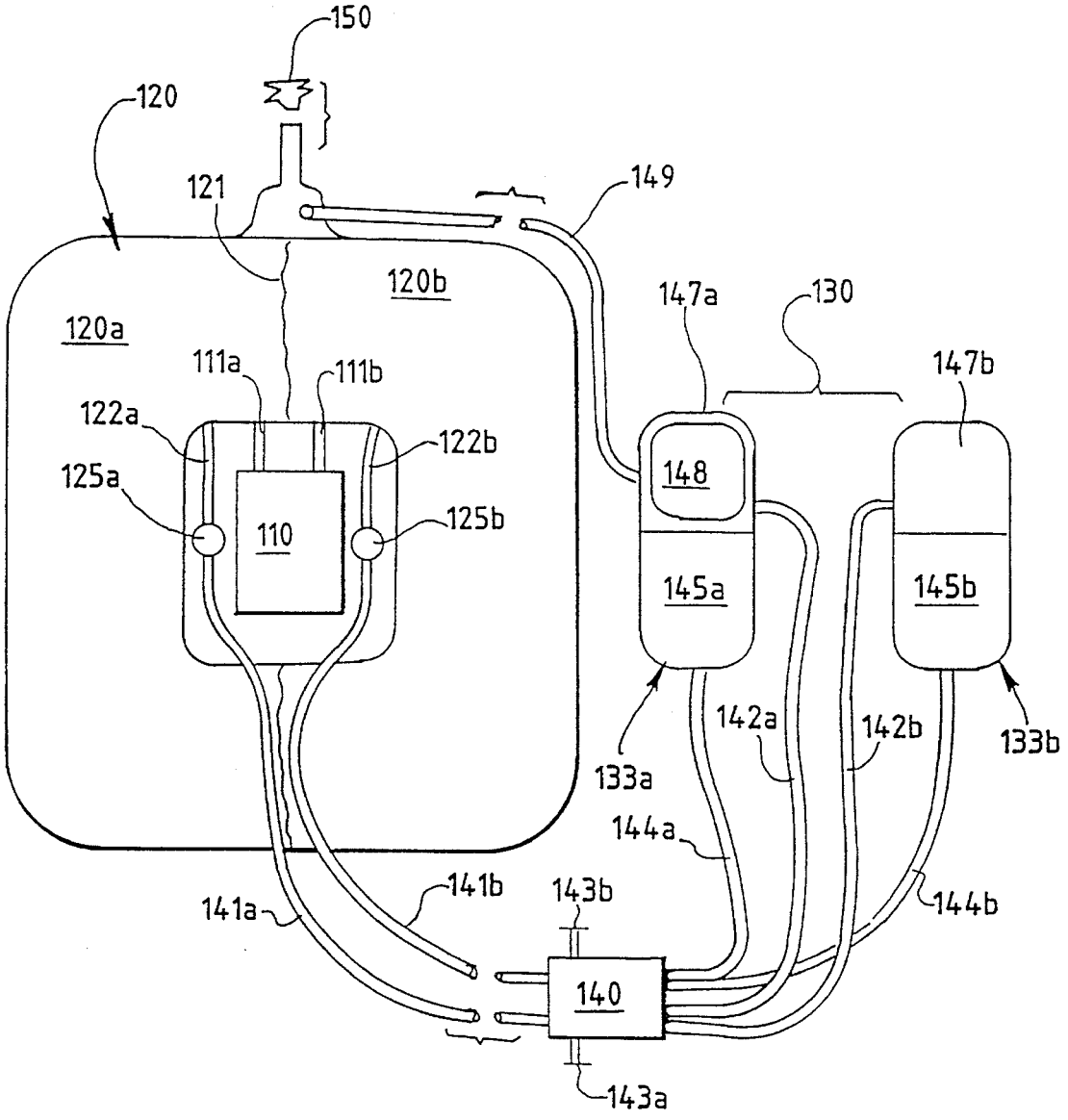
FIG. 3 is a schematic representation of one embodiment of the invention wherein graduated sequential intermittent pressure is applied to a limb.
Figure 4:
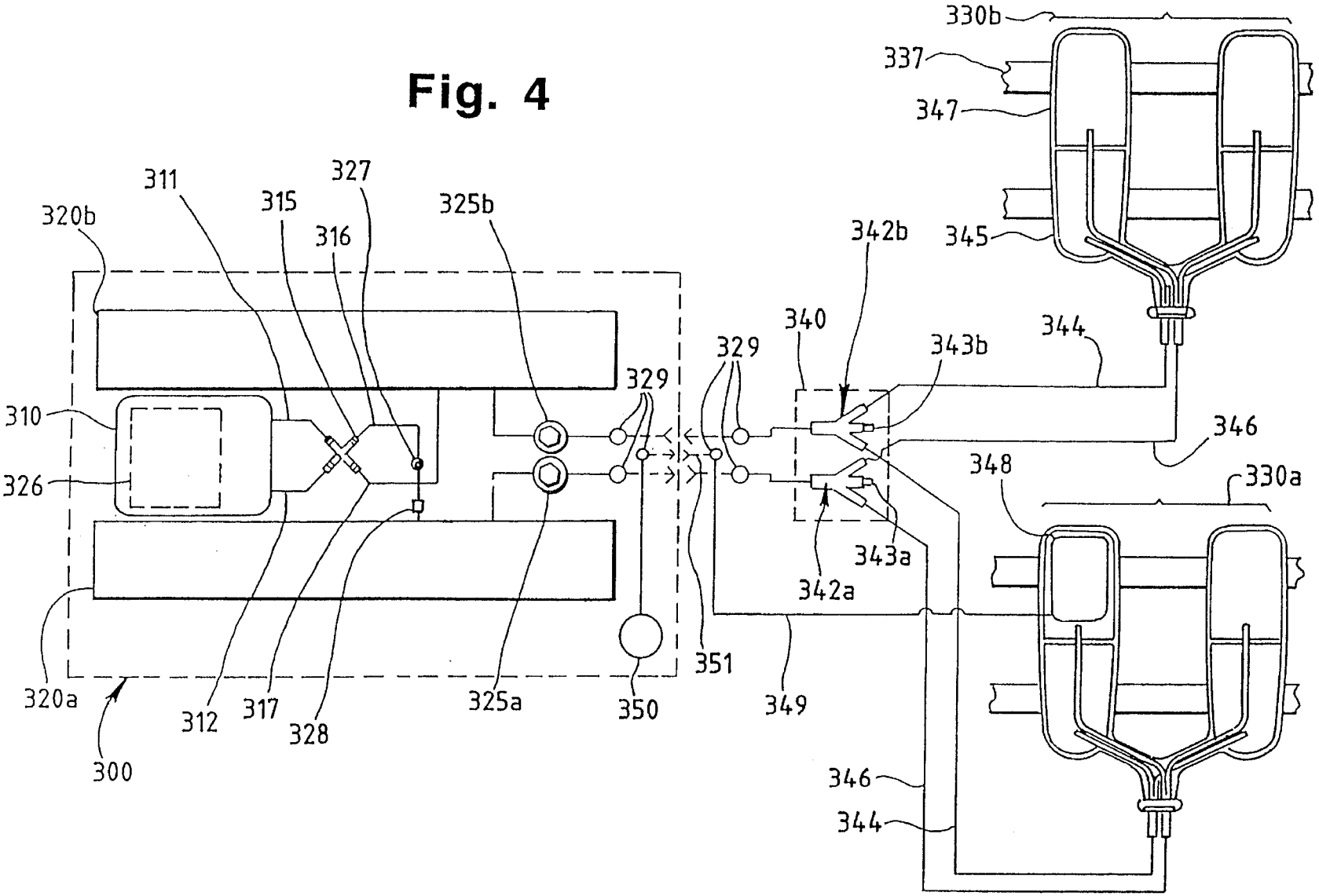
FIG. 4 is a schematic representation of a preferred embodiment of the invention wherein graduated and sequential intermittent pressure is applied to two limbs.

In FIGS. 4–6 there is depicted the present preferred commercial embodiment employing the inventions of the present system. The schematic depicted in FIG. 4 is generally similar to that depicted in FIG. 3, except that the reservoir 320 comprises two separate components 320*a* and 320*b*, and there are two sets of cuff means 330A and 330B, one for each leg. A description of the schematic of FIG. 4 and the carrying case for the entire system follows, it being understood that operation of this system is generally similar to that for the system of FIG. 3, but includes graduated and sequential compression for two cuff means.

The pump 310 runs continuously. The air from its two output tubes 311, 312, comes together at cross connector 315. (If the pump had a single output, the cross connector 315 would be a Y). The output is then divided with one leg 316 going to reservoir 320*a*, the second leg 317 to reservoir 320*b*. In the line 316 to reservoir 320*a* is a pressure relief valve 327 and a one way valve 328. Valve 327 controls the maximum pressure in the two reservoirs to about 170 mm hg, as desired.

Valve 328 passes air to reservoir 320*a* but blocks air to 320*b*. The valve 328 may be of the type disclosed and claimed in commonly assigned copending application Ser. No. 07/968,287, filed Oct. 29, 1992, entitled: Automatic Fluid Circulation System and Method, the disclosure of which is incorporated herein by reference. This cross technique allows uniform pressure in the two reservoirs 320*a,b* even if the outputs from the two sides of the pump 310 are different. The one way valve 328 permits release of pressure from reservoir 320*b* without affecting the pressure in reservoir 320*a*.

After one minute of operation the reservoirs 320*a*, 320*b* are at the desired 170 mm pressure. Two-way solenoid valve 325*b* is energized by timer 326, releasing air from reservoir 320*b* through tube connectors 329 and Y connectors 342*b* in manifold 340, via tubes 344 to the four distal air bladder compartments (medial, lateral, left and right) of two cuff means 330A, 330B. Pressure relief valve 343*b* limits the pressure to about 50 mm hg, as desired, and pressure in reservoir 320*b* falls of course to the same level. But the pressure in reservoir 320*a* remains at 170 mmHg, since outflow to reservoir 320*b* is blocked by one way valve 328. It should be noted the tube connectors preferably are noted as male female and in reverse relationship to assure proper connection of the reservoirs to the distal and proximal compartments.

About 0.5 seconds later, the second solenoid 325*a* is energized by the timer 326, releasing air from reservoir 320*a* to the four proximal compartments 347. Valve 325*a* limits the proximal pressure to about 40 mm hg, as desired, and the pressure in reservoir 320*a* falls to the same 40 mmHg.

About 4.5 seconds later timer 326 deenergizes both solenoids 325*a,b* closing the passages to both reservoirs, and opening the passages from the cuff means 330A,B to atmosphere. Pressure in the distal and proximal compartments 345,347 falls to near zero. Pressure in reservoirs 320*a* and 320*b* rises over the next minute to 170 mmHg, and the cycle starts over.

Inflation of the proximal compartment compresses the pre-inflated pressure cell 348 only if the cuff means 330A is strapped onto a leg via straps 337. This causes expansion of the bellows 350, via tube 349 and connector 351, giving a visual indication that the system is working. If the cuff means is not on the leg, the cell 348 will not be compressed, even if the system is operating normally.

If desired the cuffs of course could have more than two compartments by adding reservoirs, solenoids, tubing and timed intervals.

The bladders in the versions depicted in FIGS. 3 and 4, which include distal and proximal compartments or portions, preferably are made in the manner disclosed in applicants commonly assigned U.S. Pat. No. 5,125,400, of the general type depicted in FIGS. 11 or 16 thereof, in which the proximal aircell envelopes the distal compartment or portion, the disclosure of such patent being incorporated herein by reference. The advantage of such structure in the present invention in preventing DVT is the avoidance of any low pressure zone between the distal and proximal portions that may lead to a pooling of blood, as has been found to be the case in prior art DVT systems.

In FIGS. 5 and 6, a relatively rigid plastic shell-style carrying case 300 is provided for housing the entire system of FIG. 4, and for permitting easy portability thereof, and permitting easy mounting to a patient's bedside, if appropriate. A suitable electrical receptacle 301 is provided on one side wall 302 of the case 300, through which the appropriate electrical connections can be made by an appropriate extension cord (not shown).

As noted, illustrated in this embodiment is the system depicted in FIG. 4, which includes two separate reservoirs, 320*a* and 320*b*, fed by the single pump 310 having the timing mechanism incorporated therewithin, all provided in the case lower compartment 303. The upper compartment 304 of the case 300 (FIG. 4) permits storage of the two sets of cuff means 330A, 330B. One cuff means 330A is illustrated without a "cover" in the left hand portion of FIG. 5, and with a cover 305 and closed straps 337 in the right hand portion of FIG. 5. When disassembled for carrying, all of the necessary tubing is disconnected and the cuffs are stored in the upper compartment 304 of case 300.

As shown at the right hand side of the lower compartment 303, in right side wall 306 of case 300, there are the two valve connectors 327, one male and one female, to assure the mating connection to the proper tubes 344, 346 of the appropriate cuff members. Similarly, a connection 351 is provided for connection of the tube 349 to the bellows 350. As noted in FIG. 5, the bellows 350 is located directly in an upper wall 307 of the lower compartment 303 of the case 300 and is clearly visible during operation. An adjustable strap 308 is provided on the lower face portion 309, permitting the case 300 to be held directly on a bedside rail.

In this preferred embodiment, each reservoir 320*a* and 320*b* as made is approximately 18 inches long and five inches wide when deflated; each will inflate within the case 300 to a dimension of approximately 15 by 3 inches, having a capacity of approximately 100 cubic inches. The case 300 itself has overall dimensions of approximately 12" by 15" by 6".

Figure 7:
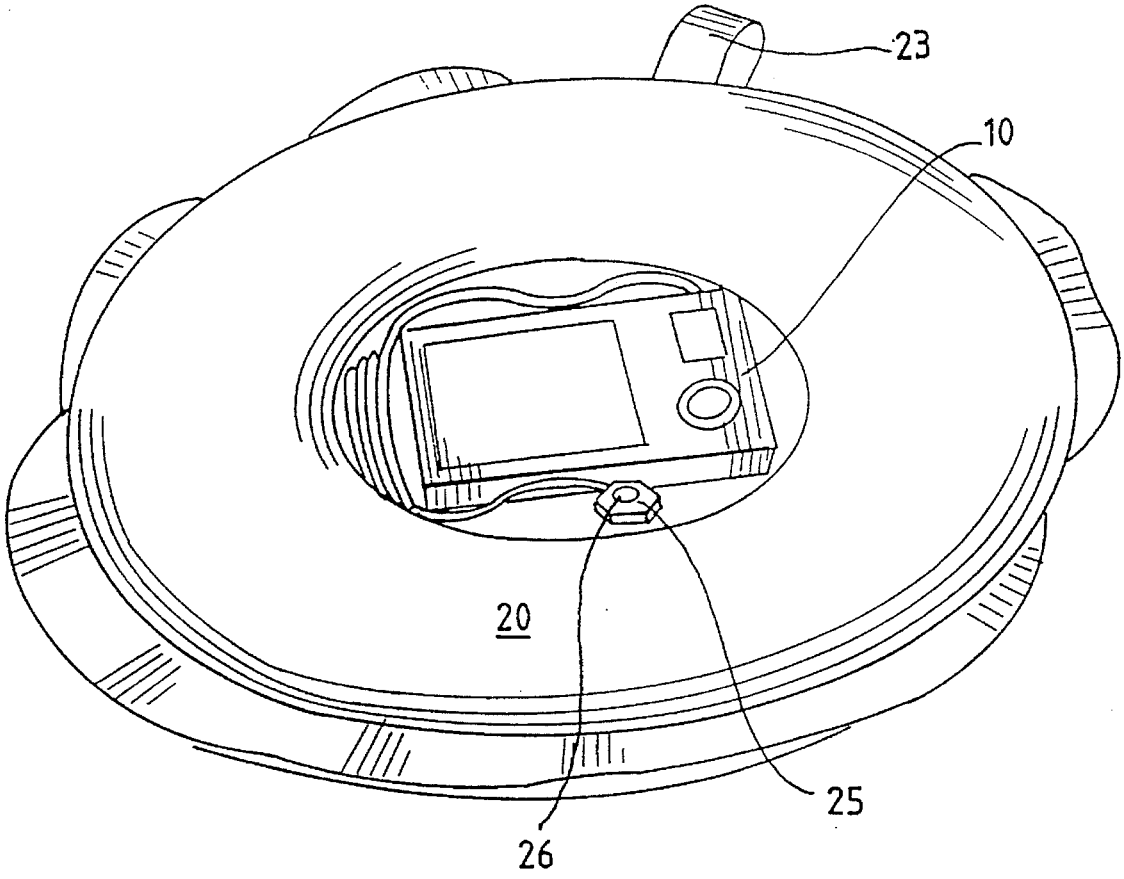
FIG. 7 is a perspective view of another embodiment of a reservoir and system of the instant invention.

In an alternate simplified embodiment as shown in FIG. 7, the reservoir 20 may be in the shape of a toroid or hollow square, and the pump means 10, valve means 25 and the timer 26 may all be mounted, such as on a support board, within the "hollow" portion of the toroid or hollow square. The reservoir 20 then serves to protect those components, and the entire system can be more compact and easier to set up and use. A looped strap 17 may be provided to hold the reservoir 20, such as from a hospital bed rail, not shown.

A system of the embodiments of FIGS. 3 or 4 of the instant application may be operated to achieve an increase in blood flow in the femoral vein of about 250%, or more, substantially greater than the acceleration achieved by the devices of the prior art. A single chamber collateral compression or circumferential cuff like FIG. 1, can also achieve an increase in blood velocity of about 250% or more.

While much of the need is for treating venous flow in only the lower leg, it is common practice to treat the thigh as well with graduated pneumatic compression. U.S. Pat. No. 4,013,069 discloses a typical system in which this is accomplished with an elaborate system of mechanical valves, and a multiplicity of tubes leading from the control system to the leg.

By the present invention, it will be understood that additional cuffs, for application to the thigh or to the foot if desired, may be provided, at but very modest increase in cost and with a minimization of additional valving, tubes and the like. Also, one or more pumps may be used if desired, but it is believed that the use of the dual reservoir system provided in FIG. 4, fed by a single pump, is the most efficient and economical. The use of the compact carrying case 300 also makes the unit highly mobile and convenient to use.

The foregoing detailed description of the specification and drawings and of the invention is given for clearness of understanding only, and no unnecessary limitations should be understood therefrom as modifications will be apparent to those skilled in the art and it is intended to cover in the following claims all such modifications.

What is claimed is:

1. An apparatus for applying therapeutic intermittent pressure to a human leg, said apparatus comprising a pump means, a fluid reservoir for receiving a substantially steady flow of pressurized fluid from said pump means, inflatable cuff means for applying pressure to the leg, said cuff means being in fluid communication with said reservoir, and said cuff means being configured to apply said therapeutic pressure substantially to the medial and lateral aspects of the leg, said cuff means comprising at least a first inflatable bladder adapted to be disposed along either the medial or lateral aspect of the leg, and wherein said cuff means further comprises a sealed, pre-inflated bladder disposed in opposition to said first inflatable bladder, means for facilitating the intermittent transmission of compressed fluid from said reservoir to said inflatable cuff means, said facilitating means comprising a valve means operatively disposed between said reservoir and said cuff means and a timer operatively coupled to said valve means, whereby said timer may be set to operate said valve means at predetermined intervals and for pre-determined periods of time to control the intermittent transmission of compressed fluid from said reservoir to said cuff means, said valve means also permitting exhaustion of fluid from said cuff means, and pressure relief means operatively coupled to said inflatable cuff means for controlling the pressure therein.

2. An apparatus for applying therapeutic intermittent pressure to a human leg, said apparatus comprising a pump means, a fluid reservoir for receiving a substantially steady flow of pressurized fluid from said pump means, inflatable cuff means for applying pressure to the leg, said cuff means being in fluid communication with said reservoir, and said cuff means being configured to apply said therapeutic pressure substantially to the medial and lateral aspects of the leg, means for facilitating the intermittent transmission of compressed fluid from said reservoir to said inflatable cuff means, said facilitating means comprising a valve means operatively disposed between said reservoir and said cuff means and a timer operatively coupled to said valve means, whereby said timer may be set to operate said valve means at predetermined intervals and for pre-determined periods of time to control the intermittent transmission of compressed fluid from said reservoir to said cuff means, said valve means also permitting exhaustion of fluid from said cuff means, pressure relief means operatively coupled to said inflatable cuff means for controlling the pressure therein, and further including an air cell adapted to be operatively disposed between said cuff means and the leg, and a bellows in sealed fluid communication with said air cell, said air cell and bellows adapted to provide an indication of the intermittent application of therapeutic pressure to said body portion.

3. A method for promoting accelerated venous blood flow in a human leg, said method comprising;

providing at least two pressurized air reservoirs which receive a substantially steady flow of pressurized air from a single air pump;

providing a cuff means for receiving said pressurized air, said cuff means being in operative contact with the associated leg and having a distal portion in fluid communication with a first reservoir and a proximal portion in fluid communication with a second reservoir;

cyclically releasing an intermittent pulse of air from said first reservoir to inflate said distal portion at one pressure, and releasing an intermittent pulse of air from said second reservoir to inflate said proximal portion at a lesser pressure, whereby the pressure of said air pulses is transmitted via said distal and proximal portions to the leg to effectively accelerate the venous flow therein;

and providing a valve means for maintaining the pressure in said second reservoir during the release of said pulse of air from said first reservoir.

4. The method of claim 3 wherein said cuff means is in operative contact with portions of the medial and lateral aspects of the leg.

5. The method of claim 3 wherein said pressurized air is transmitted first to said distal portion and then to said proximal portion to provide sequential pressurization to the leg.

6. The method of claim 5 wherein the pressure in said distal portion is greater than the pressure in said proximal portion to provide graduated pressurization to the leg.

7. An apparatus for applying therapeutic intermittent pressure to a human leg, said apparatus comprising a single pump means;

first and second air reservoirs, each in fluid communication with said pump means so as to receive a substantially steady flow of pressurized air therefrom;

at least one inflatable cuff means adapted to be in operative contact with the leg, said cuff means having a distal portion in fluid communication with said first reservoir and a proximal portion in fluid communication with said second reservoir;

means for intermittently releasing a pulse of air from said first reservoir to inflate said distal portion at one pressure, and for intermittently releasing a pulse of air from said second reservoir to inflate said proximal portion at a lesser pressure, whereby the pressure of said air pulses is transmitted via said distal and proximal portions to the leg to effectively accelerate the venous flow therein, said intermittent release means being capable of maintaining the pressure in said second reservoir during the release of said pulse of air from said first reservoir.

8. The apparatus of claim 7 wherein said means for intermittently releasing the pulses of air from said first and second reservoirs is capable of releasing said pulses of air at different times to cause said distal portion and said proximal portion of said cuff means to be pressurized at different times, so as to provide sequential therapeutic pressure to the leg.

9. The apparatus of claim 7 wherein said means for intermittently releasing pulses of air comprise a first two-way solenoid valve operatively disposed between said first reservoir and said distal portion, a second two-way solenoid valve operatively disposed between said second reservoir and said proximal portion, and a timer operatively coupled to said first solenoid valve and said second solenoid valve, such that said timer can cause each of said solenoid valves to open at pre-determined intervals and to remain open for a pre-determined duration, to provide intermittent pressurization of said distal and proximal portions.

10. The apparatus of claim 9 further comprising a second inflatable cuff means adapted to be in operative contact with a second leg, said second cuff means having a distal portion coupled in fluid communication by said first solenoid valve to said first reservoir, and a proximal portion coupled in fluid communication by said second solenoid valve to said second reservoir, such that said apparatus can apply intermittent pressure to said first cuff means and said second cuff means to effectively accelerate venous flow in the first leg and the second leg.

11. The apparatus of claim 10 further including a visual indicator means, said indicator means comprising an air cell mounted on said cuff means and in closed fluid communication with a bellows, such that when said cuff means are pressurized, pressure will be transmitted to said air cell and to said bellows, such that said bellows will perceptibly respond to said pressure to provide a visual indication of said pressurization.

12. The apparatus of claim 11 further including a portable carrying case, said case adapted to fixedly contain said first reservoir, second reservoir, pump means, timer, first valve, and second valve; and adapted to contain said cuff means, such that said cuff means can be removed while maintaining said cuff means in fluid communication with said first and second reservoirs; such that said apparatus may be readily transported for convenience.

13. The apparatus of claim 12 wherein said carrying case is semi-rigid and closable, and has a connector for a power supply mounted through a wall thereof, and fluid communication means mounted in a wall thereof for connecting said cuff means to said first and second valves, such that said apparatus can be operated when said cuff means are removed from said case and said case is closed.

14. The apparatus of claim 13 wherein said bellows is mounted through a wall of said carrying case, such that said visual indication may be seen when such case is closed.

15. The apparatus of claim 7, wherein said distal and proximal portions of said inflatable cuff means are substantially adjacent one other to prevent any discontinuity in pressurization of the associated 6*g* between said distal and proximal portions of said cuff means, thereby reducing the likelihood of pooling of blood in the area between the distal and proximal portions.

* * * * *